US006790017B2

(12) United States Patent
Takura et al.

(10) Patent No.: US 6,790,017 B2
(45) Date of Patent: Sep. 14, 2004

(54) INTEGRATED PUMP WITH SERIAL-CONNECTED PUMP UNITS ARRANGED IN PARALLEL

(75) Inventors: Toshiyasu Takura, Tokyo (JP); Yoshifumi Tanabe, Tagata-gun (JP); Hiroshi Satoh, Mishima (JP); Kunitomi Cho, Numazu (JP)

(73) Assignees: Toshiba Tec Kabushiki Kaisha, Tokyo (JP); DMW Corporation, Tokyo (JP)

( * ) Notice: Subject to any disclaimer, the term of this patent is extended or adjusted under 35 U.S.C. 154(b) by 0 days.

(21) Appl. No.: 10/133,417

(22) Filed: Apr. 29, 2002

(65) Prior Publication Data

US 2003/0049143 A1 Mar. 13, 2003

(30) Foreign Application Priority Data

Sep. 7, 2001 (JP) ..... 2001-271773

(51) Int. Cl.[7] ..... F04B 35/04

(52) U.S. Cl. ..... 417/423.5; 417/244

(58) Field of Search ..... 417/244, 423.5, 417/424.1, 245, 246, 247, 248, 249, 250, 251, 252, 253, 255, 256, 257–268, 392, 423.14; 415/52.1, 182.1, 183, 184, 206, 207; 416/175, 203, 204 R, 233 R

(56) References Cited

U.S. PATENT DOCUMENTS

| | | | | | |
|---|---|---|---|---|---|
| 2,653,552 | A | * | 9/1953 | Geeraert | 103/152 |
| 4,963,075 | A | * | 10/1990 | Albertson et al. | 417/273 |
| 5,713,727 | A | * | 2/1998 | Veronesi et al. | 417/356 |
| 6,089,823 | A | * | 7/2000 | Cronin et al. | 415/121.1 |
| 6,109,887 | A | | 8/2000 | Takura et al. | |
| 2001/0014290 | A1 | * | 8/2001 | Takura et al. | 417/371 |

* cited by examiner

*Primary Examiner*—Justine R. Yu
*Assistant Examiner*—John F. Belena
(74) *Attorney, Agent, or Firm*—Oblon, Spivak, McClelland, Maier & Neustadt, P.C.

(57) ABSTRACT

The present invention is an integrated pump having structure where a plurality of cell pumps having an inlet and an outlet to discharge fluid drawn from a consolidated inlet to the consolidated outlet is connected in series or parallel. A plurality of cell pump may be connected in parallel to constitute an integrated pumps. The integrated pump of the present invention can obtain a desired output connecting in series and parallel a number of cell pumps. For a high output integrated pump where many cell pumps are connected to provide high capacity and high head, by unitizing the individual cell pumps during transportation or installation, the transportation and installation work for the integrated pump can be easily done.

4 Claims, 12 Drawing Sheets

INTEGRATED PUMP WITH SERIAL-CONNECTED PUMP UNITS ARRANGED IN PARALLEL

CROSS REFERENCE TO RELATED APPLICATION

The present application is based on Japanese Patent Application No. P2001-271773 filed on Sep. 7, 2001, which is incorporated herein by reference.

BACKGROUND OF THE INVENTION

1. Field of the Invention

This invention is related to a pump formed as an integral structure by the integration of multiple parts of in-line pumps forming the flow paths in the internals and externals of a motor.

2. Discussion of the Background

An example of multiple piece pumps, is found in Japanese Application Publication No. P 2000-240564, a pump unit, connected by pipes and flanges so as to enable dismantling and assembly as separate and free by support the frame of rectangular parallel piped cross-lattice of multiple pumps, was made public. In case of the pump device of such construction, for increasing size of such device, necessary fixed installation spaces becomes a problem area. Further for single pump, output of each pump is fixed. Hence, in case pump of desired output is not available as a standard product, the same must be specially ordered. Generally, as the pump output desired by users is not uniform, there is a strong tendency of limited production of a wide variety of products. Hence the cost tends to be high.

Above this, a high output pump for high capacity as well as high head, is very heavy and big, and large effort is required for transportation and installation which becomes a problem.

SUMMARY OF THE INVENTION

The first basic purpose of this invention is, without depending on limited production of a wide variety of products, obtaining a pump having output corresponding to needs of each type by the integration of standard pumps.

Further, reduction in the starting current at time of starting of large output pumps, and achieving easy and efficient flow control of the same, is the second purpose of this invention.

And the third aim of this invention is to make easy the transportation and the installation of large output pump for high capacity and high head.

The integrated pump of this invention is made up of multiple cell pumps each having an inlet and an outlet, fluid sucked in from the above mentioned inlet is sent towards the above mentioned outlet. It is also equipped with a consolidated inlet for sucking fluid and a consolidated for discharging the fluid. Depending upon an operation of the above mentioned cell pump, fluid is sucked in from the above mentioned consolidated inlet, sucked in fluid is then completely sent from the above mentioned inlet of the above mentioned cell pump towards the above mentioned outlet, and fluid discharged from the above mentioned outlet of the above mentioned cell pump is then finally discharged from the above mentioned consolidated outlet. Therefore, by addition of connected cell pumps, the head can be increased easily, and as pump output can be improved, desired output can be achieved depending upon number of connected cell pumps. Therefore, pumps having various output can be obtained without depending upon limited production of a wide variety of products.

Further, by connecting many cell pumps for high capacity and high head, to constitute a high output pump, during transportation or installation, by unitizing individual cell pumps the transportation and the installation work can be made very easy.

Further, while starting of high flow, high head pump, individual cell pumps can be started one by one with some time interval and thus excess input current can be controlled.

Also, the control of pump flow rate can be achieved by operation of required cell pumps only. As only necessary cell pumps required for the correct flow and head need to run, the energy saving operation can be achieved.

BRIEF DESCRIPTIONS OF THE DRAWINGS

A more complete understanding of the present invention and many of the attendant advantages thereof will be readily obtained as the same becomes better understood by reference to the following detailed description when considered in connection to the attached drawings wherein:

As the first application of the integrated pump of this invention,

DETAILED DESCRIPTION OF THE PREFERRED EMBODIMENTS

This invention is an integrated pump where multiple cell pumps are connected in series or parallel, where the cell pumps connected in series are also connected in parallel and output is increased.

Following is the explanation of the application of this invention by referring to FIGS. 1 to 12.

Embodiment 1

The first embodiment of the invention is explained with reference to FIGS. 1 to 4.

Figure 1:
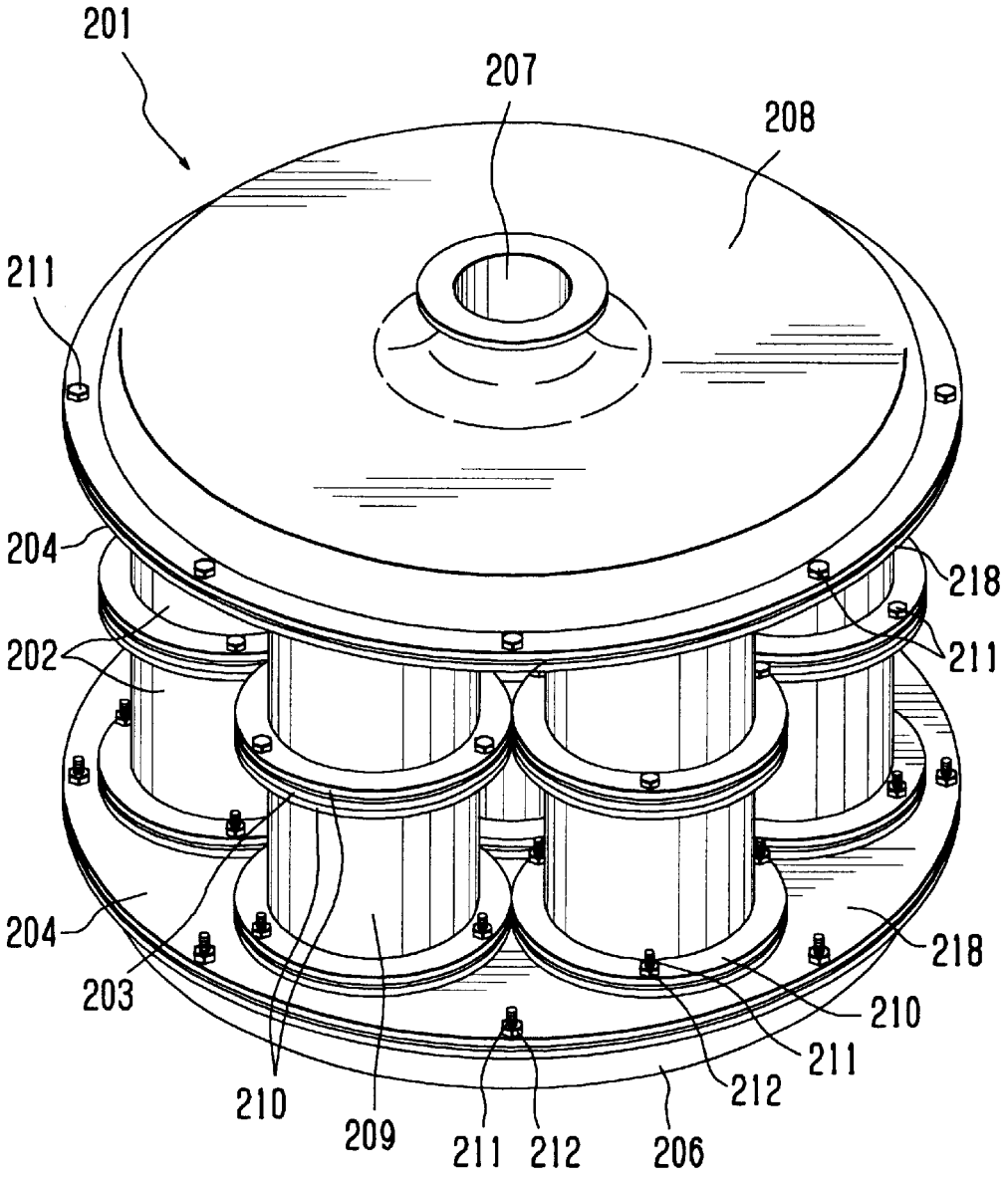
FIG. 1 is the complete isometric view.

FIG. 1 is the isometric view of a cell pump viewed from the top.

Figure 2:
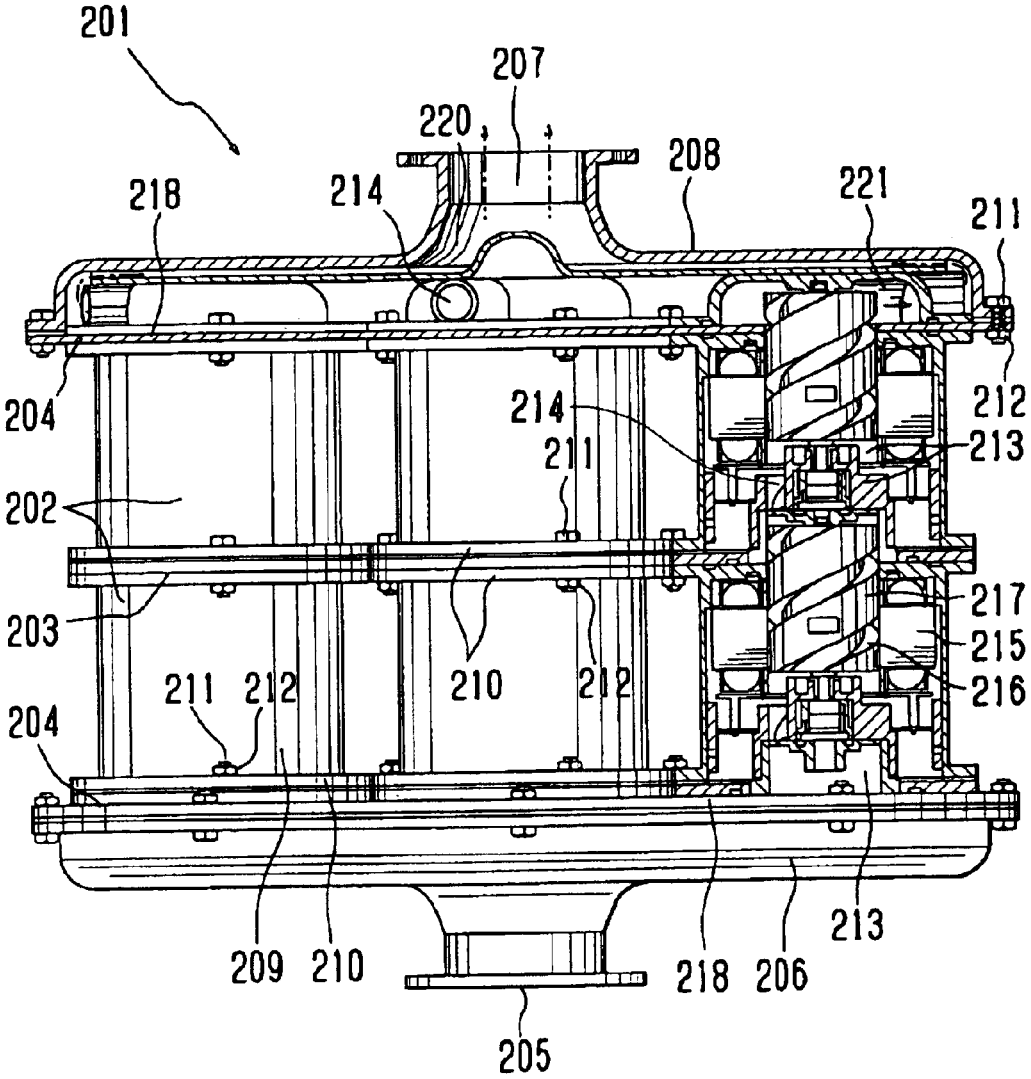
FIG. 2 is a full body elevation showing one part of the cell pump cut.

FIG. 2 is the full body elevation.

Figure 3:
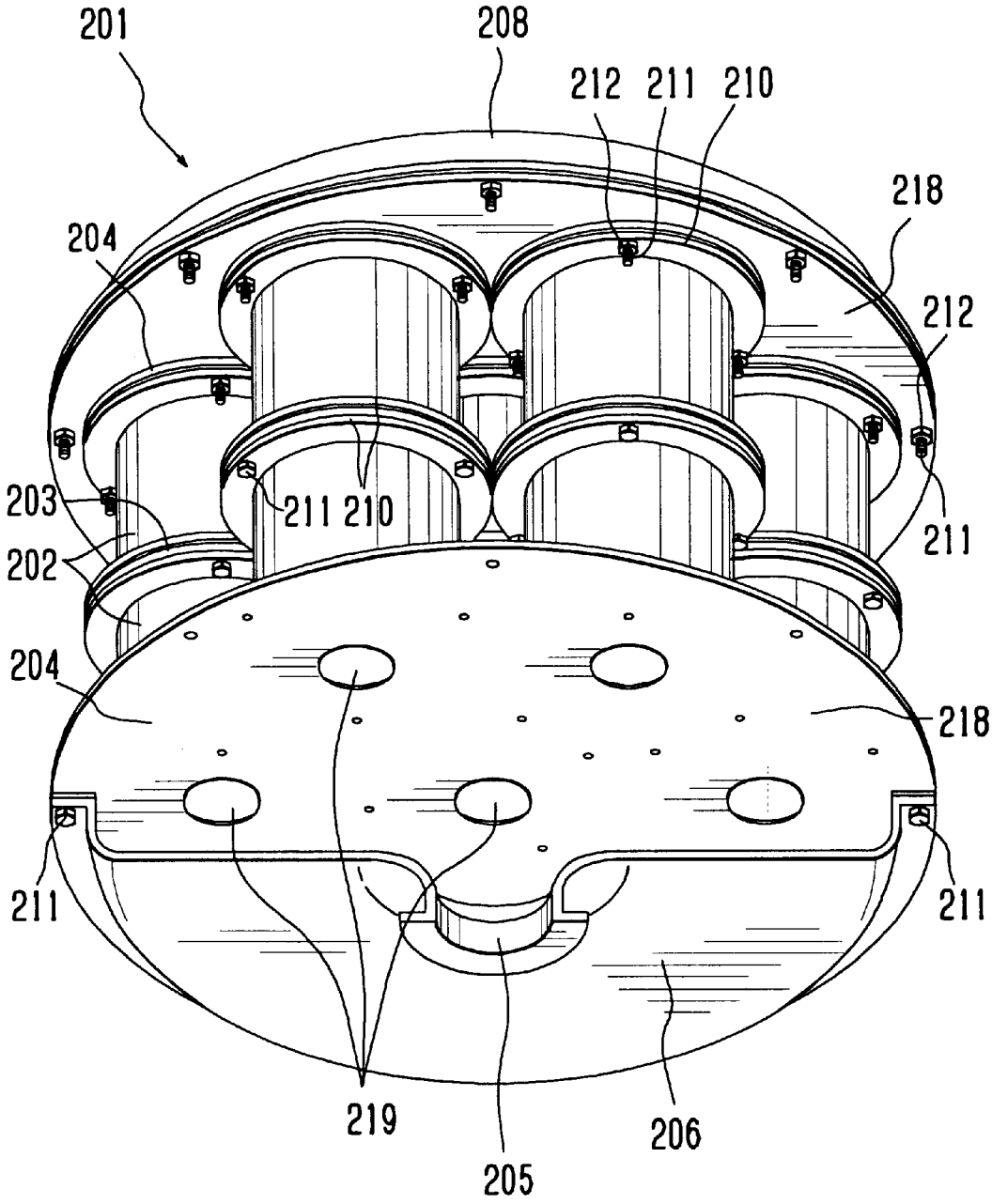
FIG. 3 is an isometric view seen from the bottom with a cutting of the consolidated parallel inlet.

FIG. 3 is the full body isometric view viewed from the bottom with one section of a consolidated parallel inlet cut.

Figure 4:
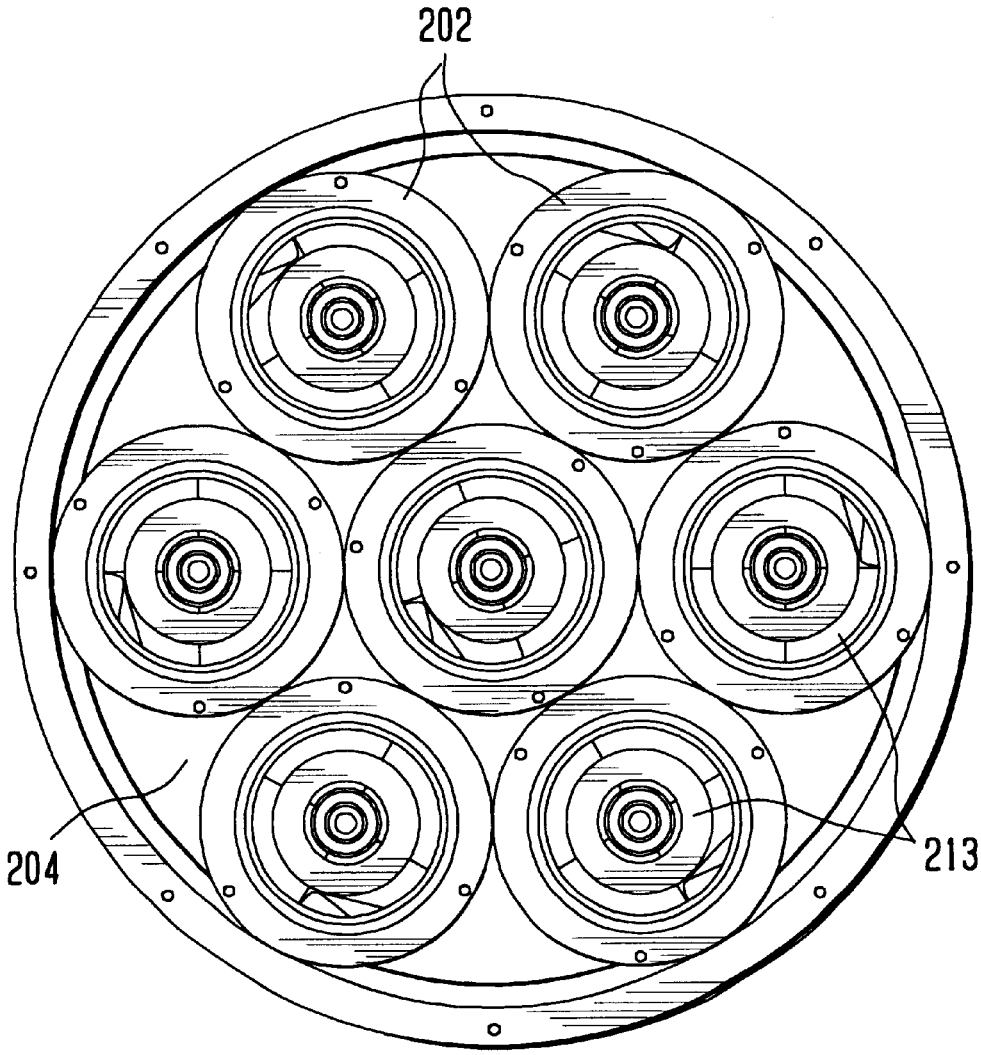
FIG. 4 is a plane figure, showing the outlet side of cell pumps arranged in parallel, viewed from a circular fixing plate.

FIG. 4 is the plane figure viewed from a circular fixing plane, showing a cell pump arranged in parallel configuration.

The integrated pump 201 of this application is of a structure using series type and parallel type together. In short, integrated pump 201 has two cell pumps 202 connected in series to form series connected structure 203. Further, multiple such two cell pumps 202 connected in series are then arranged in parallel to form parallel connected structure 204. Consolidated inlet body 206 having consolidated inlet 205 is provided on the suction side, and consolidated outlet body 208 having consolidated outlet 207 is provided on the discharge side of this structure.

Hence, the integrated pump 201 has a flow structure wherein, in case of operation of cell pump 202, fluid enters through the consolidated inlet 205, is guided to a inlet 213 of cell pump 202, and after being discharged from outlet 214 of cell pump 202, it is guided towards the consolidated outlet 207. This flow structure is realized because of series connected structure 203, parallel connected structure 204, consolidated inlet body 206 and consolidated outlet body 208.

The series connected structure 203 having each cell pump 202 connected in series is a structure wherein flange 210, formed at the end of housing 209 of each cell pump 202, is fixed by bolts 211 and nuts 212. These individual cell pumps 202 connected in series are each provided with inlet 213 and outlet 214. Inside the cylindrical stator 215 a free rotating rotor 217 is provided which has an axial impeller 216 that sends the fluid sucked in from inlet 213 towards outlet 214, in the axial direction.

Now as is clear from FIG. 1 to FIG. 4, out of a cell pumps 202 arranged in series, rotor 217 of the cell pump positioned at suction side of the fluid is arranged so as to get into inlet 213 of the cell pump 202 positioned at the discharge side of the fluid.

Then as is clear from FIG. 1 to FIG. 4, parallel connected structure 204, wherein series connected two cell pumps 202 are arranged in parallel, is a structure made up of multiple two series connected cell pumps 202 fixed between two circular fixing plates 218. In case of such a fixed structure, flange 210 formed at the end of each cell pump 202, is fixed by means of bolts 211 and nuts 212, on each fixing plate 218.

Here, an opening 219 is provided on each fixing plate 218, corresponding to inlet 213 and outlet 214 positioned on both sides of two cell pumps 202 connected in series, making suction and discharge operation of the fluid possible.

Like this, for parallel connected structure 204, consolidated inlet body 206 on the suction side of the fluid and consolidated outlet 208 on the discharge side of the fluid are provided. The consolidated inlet body 206 and consolidated outlet body 208 are in the shape of a flat cover, and parallel consolidated inlet 205 and parallel consolidated outlet 207 are formed in the middle of each respectively. Such consolidated inlet body 206 and consolidated outlet body 208 are also fixed by means of bolts 211 and nuts 212 to individual fixing plates 218.

Here a space is formed between a consolidated inlet body 206 and the suction side fixing plate 218 as well as between consolidated outlet body 208 and discharge side fixing plate 218 respectively. It is possible to form a pressure room 220, particularly in the space formed between consolidated outlet body 208 and discharge side fixing plate 218. Further, in case of this embodiment, for discharge side cell pump 202, pressure room 221 is formed at its discharge mouth 214. Regarding such a structure, after starting of each cell pump 202, depending upon rotation of axial impeller 216 of each cell pump 202, fluid is sucked in from parallel consolidated inlet 205, flows from inlet 213 of each cell pump 202 through the axial impeller 216 towards outlet 214, and is discharged from parallel consolidated outlet 207.

Here, in this application, one integrated pump 201 is formed by integrating single cell pump 202 in series as well as in parallel. Thus, on increasing the number of connected cell pumps 202, head can be increased depending upon series connection of individual cell pumps 202, capacity can be increased depending upon the parallel connection of cell pumps 202, and subsequently output of the pump on the whole can be increased and hence without depending upon the method of multiple variety low production, it is possible to achieve a pump of different outputs. Further, by connecting many cell pumps 202 for high capacity and high head, even if pump becomes of high output, by unitizing individual cell pumps 202 during the transport or the installation, the same can be made easy.

Embodiment 2

The second embodiment of this invention is explained with reference to FIG. 5 and FIG. 6.

The explanation will be shortened, as one section is similar to one part of the first application of this integrated pump.

Figure 5:
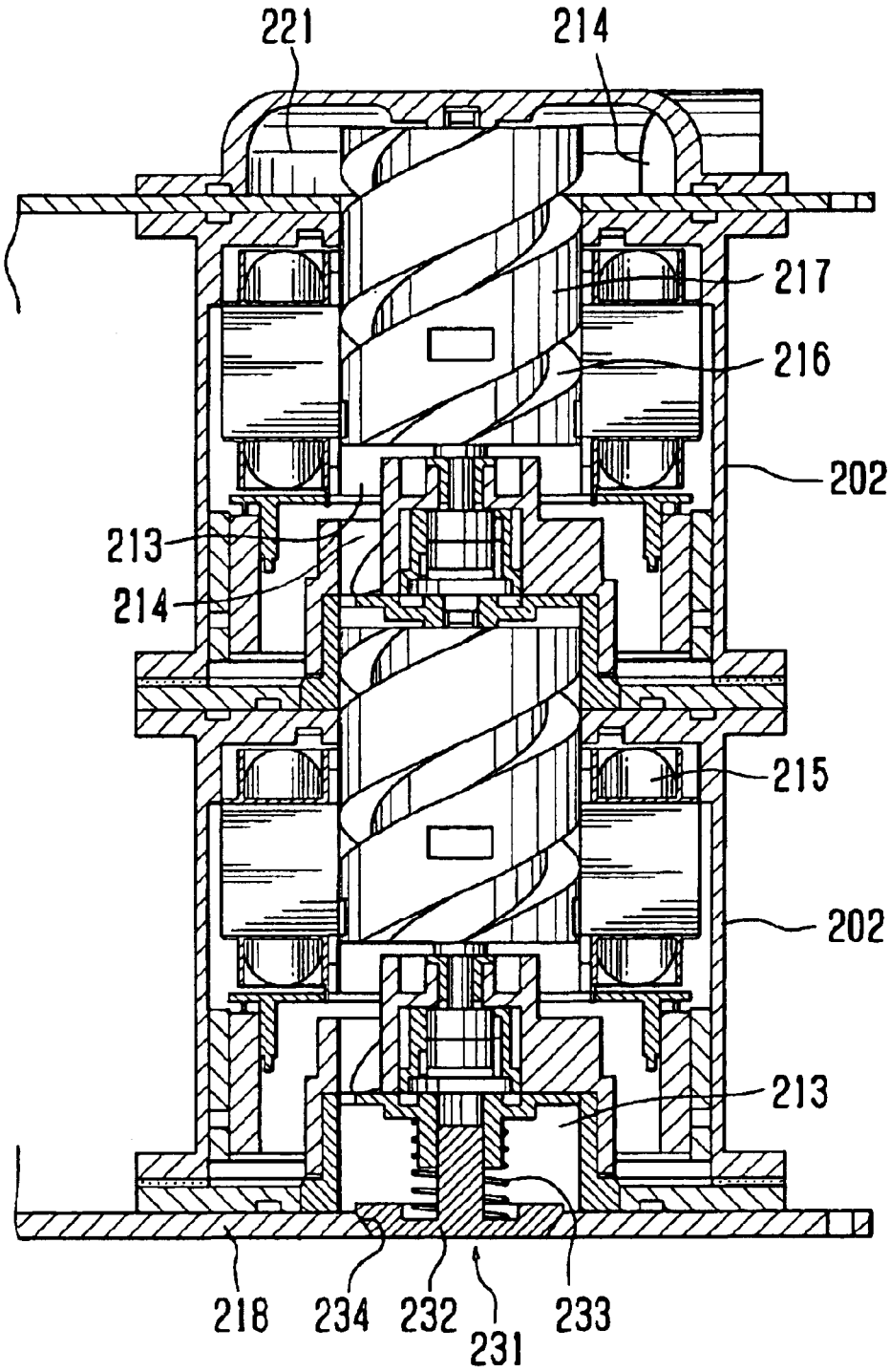
FIG. 5 is a vertical cross-section showing the internal structure of the cell pumps equipped with the check valve, as a second application of the integrated pump of this invention.

FIG. 5 is the vertical cross-section showing the internal structure of the cell pump equipped with a check valve.

Figure 6:
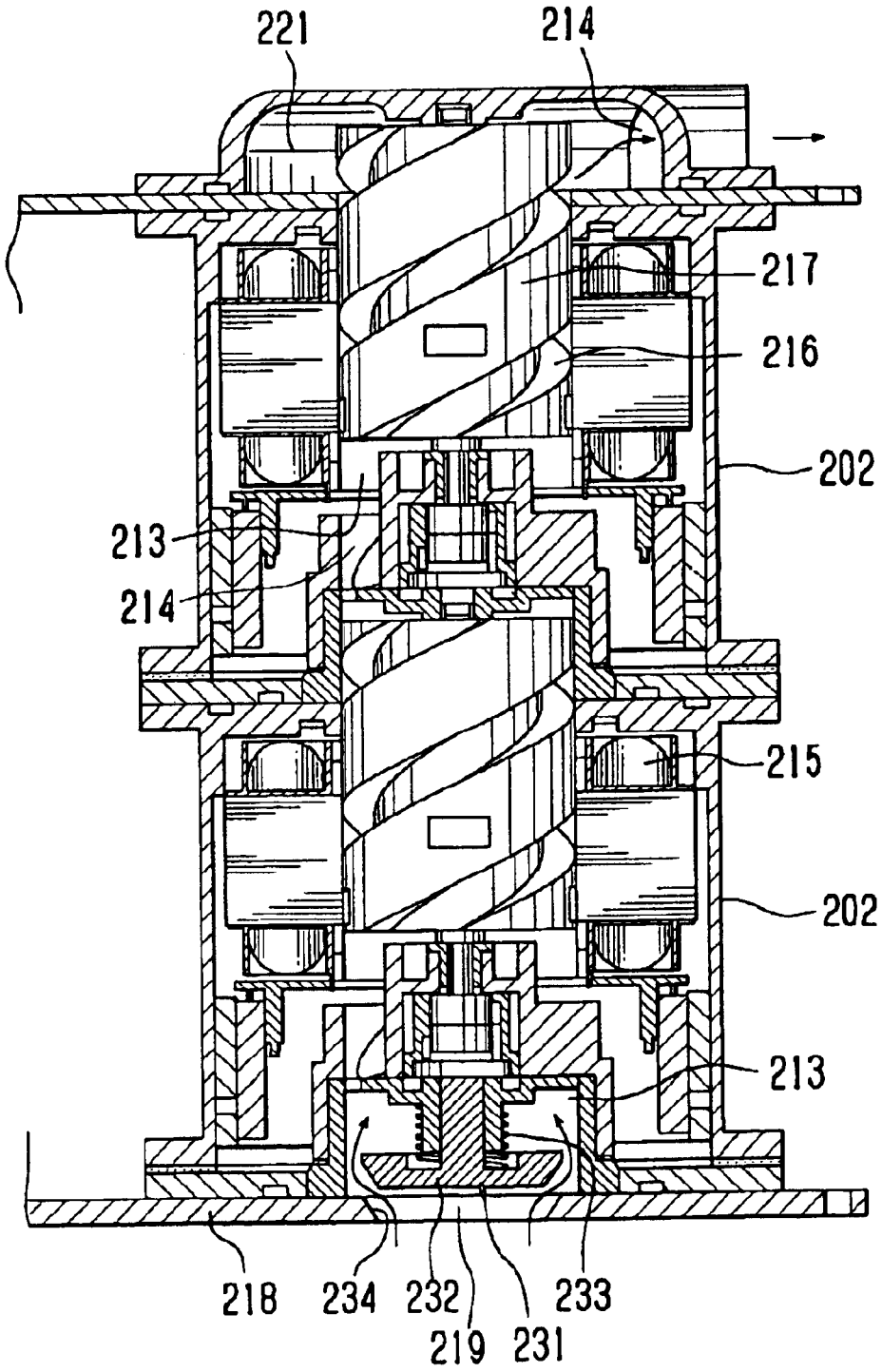
FIG. 6 is a full body vertical cross-section, showing the condition of flow at suction and discharge with the check valve open.

FIG. 6 is the full body vertical section, showing the fluid suction and discharge condition with the check valve open.

In this embodiment, in series connected structure 203, out of the two cell pumps connected in series, a check valve is provided and positioned at suction mouth 213 of suction side cell pump 202. The check valve 231 is so arranged as to pull in the suction direction a free sliding valve 232 filled to the suction side cell pump 202. This valve 232 opens and closes the opening 219 formed on the fixing plate 218 shaping the parallel connected structure 204. For this, opening 219 is formed in a taper shape, tapering out on the inner side to form a valve sheet 234 matching to the valve 232.

With such an arrangement, as indicated in FIG. 6, with starting of the cell pump 202, the check valve 231 opens against to force of the spring 233, thus enabling flow of fluid into the cell pump 202. Thus also, for non-started cell pump 202, due to the check valve 231 back flow of fluid from cell pump 202, i.e. back flow of the fluid from inlet 213 can be prevented.

Such type of fluid back flow can occur when one cell pump 202 is started. However, due to the check valve 231, such a phenomenon is positively prevented, thus avoiding the output drop of integral pump 201 in case any cell pumps are stopped in control.

Embodiment 3

Figure 7:
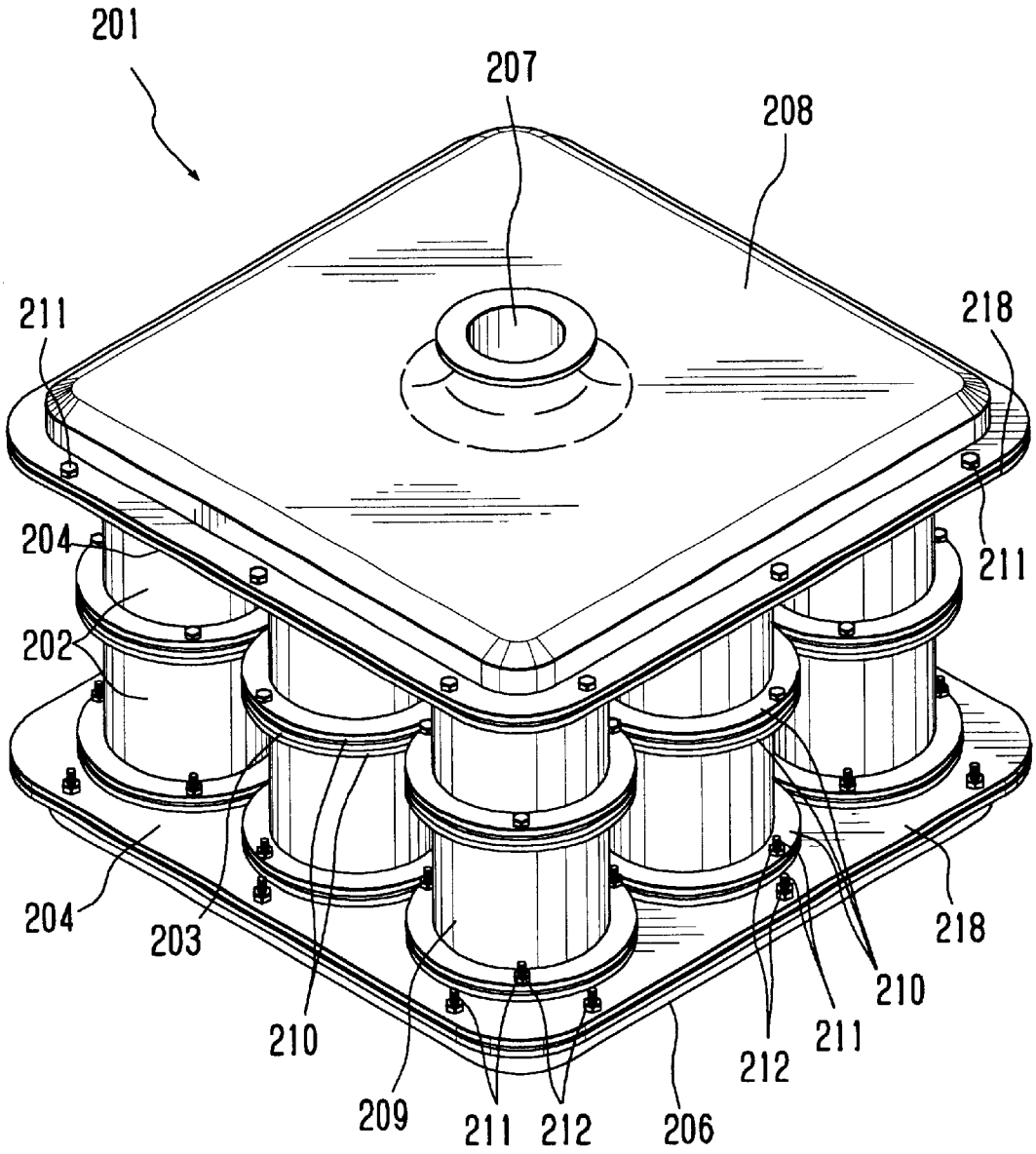
FIG. 7 is a full body isometric view seen from top, as a third application of the integrated pump of this invention.
Figure 8:
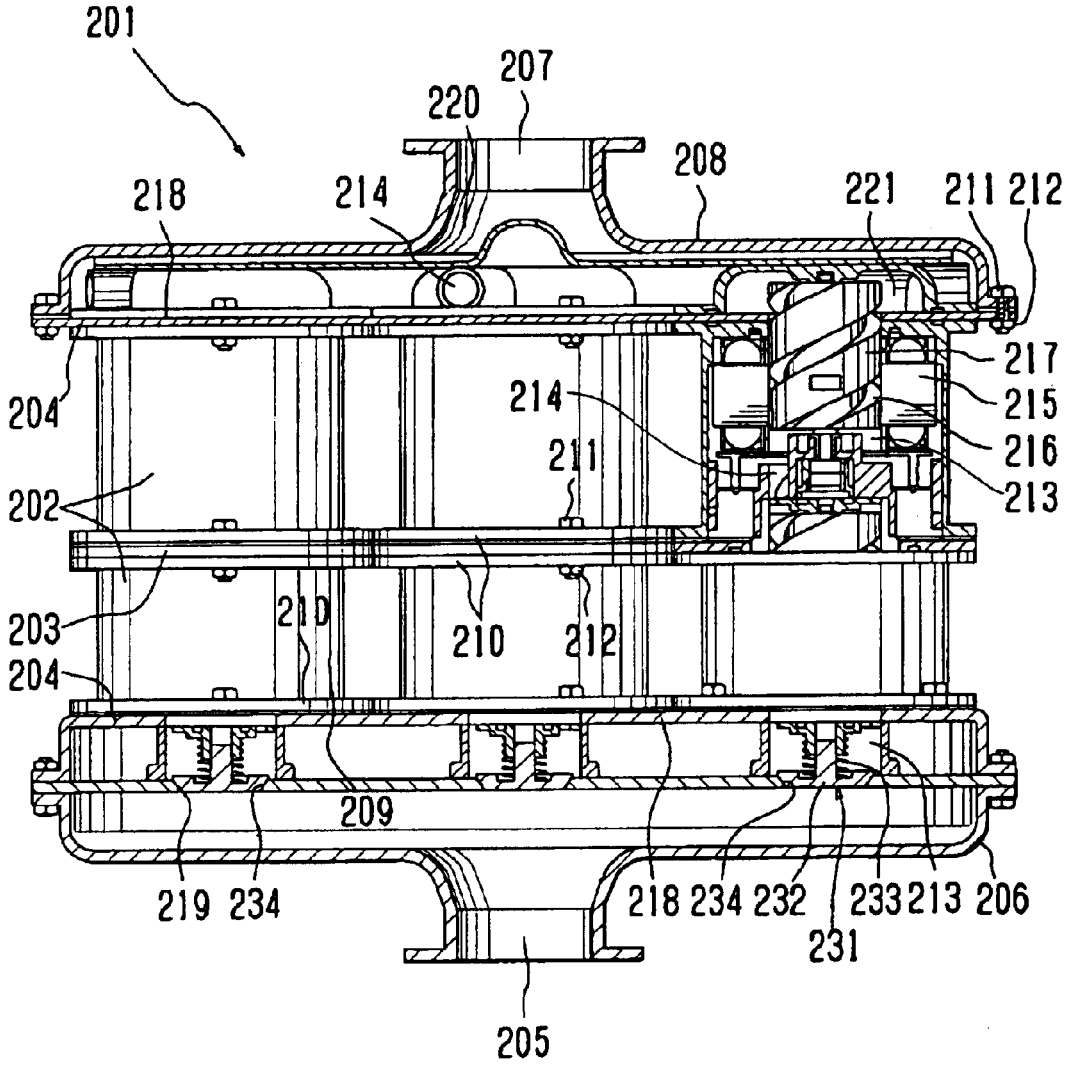
FIG. 8 is a partial vertical cross-section of above.

As shown in FIG. 7 and FIG. 8, the integrated pump 201 of this application has a structure of 2 cell pumps 202 connected in series and arranged in 3 rows and then, for series connected structure 203, out of 2 cell pumps 202 connected in series, check valve 231 is provided at the inlet 213 of the suction side cell pump 202.

Thus various integrated pumps are possible depending upon arrangements of cell pump 202.

Embodiment 4

The fourth embodiment of the integrated pump of this invention is explained with reference to FIG. 9. The explanation is abbreviated, as one part of this application is similar to the embodiment 1.

Figure 9:
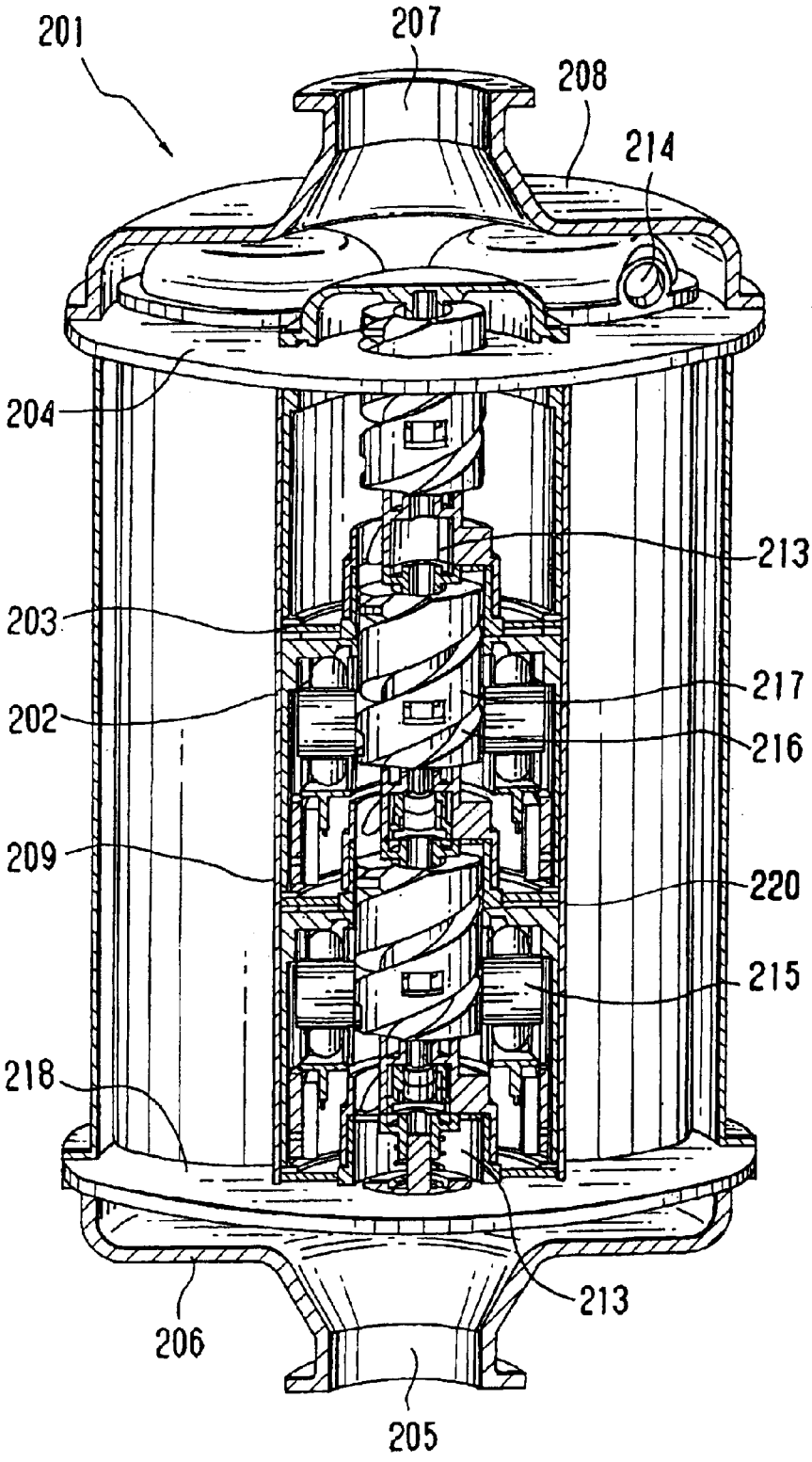
FIG. 9 is a full body isometric view, as a fourth application of the integrated pump of this invention.

FIG. 9 is the full body isometric view seen from the top and cutting one part of the cell pump. Integrated pump 201 of this application is basically of the similar structure as that of the integrated pump of the embodiment 1.

However there is a difference of two points. One is that 3 cell pumps 202 are connected directly from a series connected structure, and the second is that only 3 assemblies of cell pump 302 connected in such a structure are fixed between two numbers of fixing plates 218 and further are enclosed within external pipe 220.

Thus, various types are possible depending upon the arrangement of cell pump 202.

Now, as a different arrangement, only 1 assembly of multiple pump 202 connected in series for series connected structure 203, fixed between 2 numbers of fixing plates 218, and it is better to have integrated pump 201 only as a series connected structure and not a parallel arranged structure.

In such a case, on the suction side of multiple cell pumps 202 connected in series, it is possible to provide consolidated inlet body 206 having the series connected inlet instead of parallel connected inlet 205, as well as provide consolidated outlet body 208 having the series connected outlet instead of parallel connected outlet 207 on the discharge side.

Embodiment 5

Figure 10:
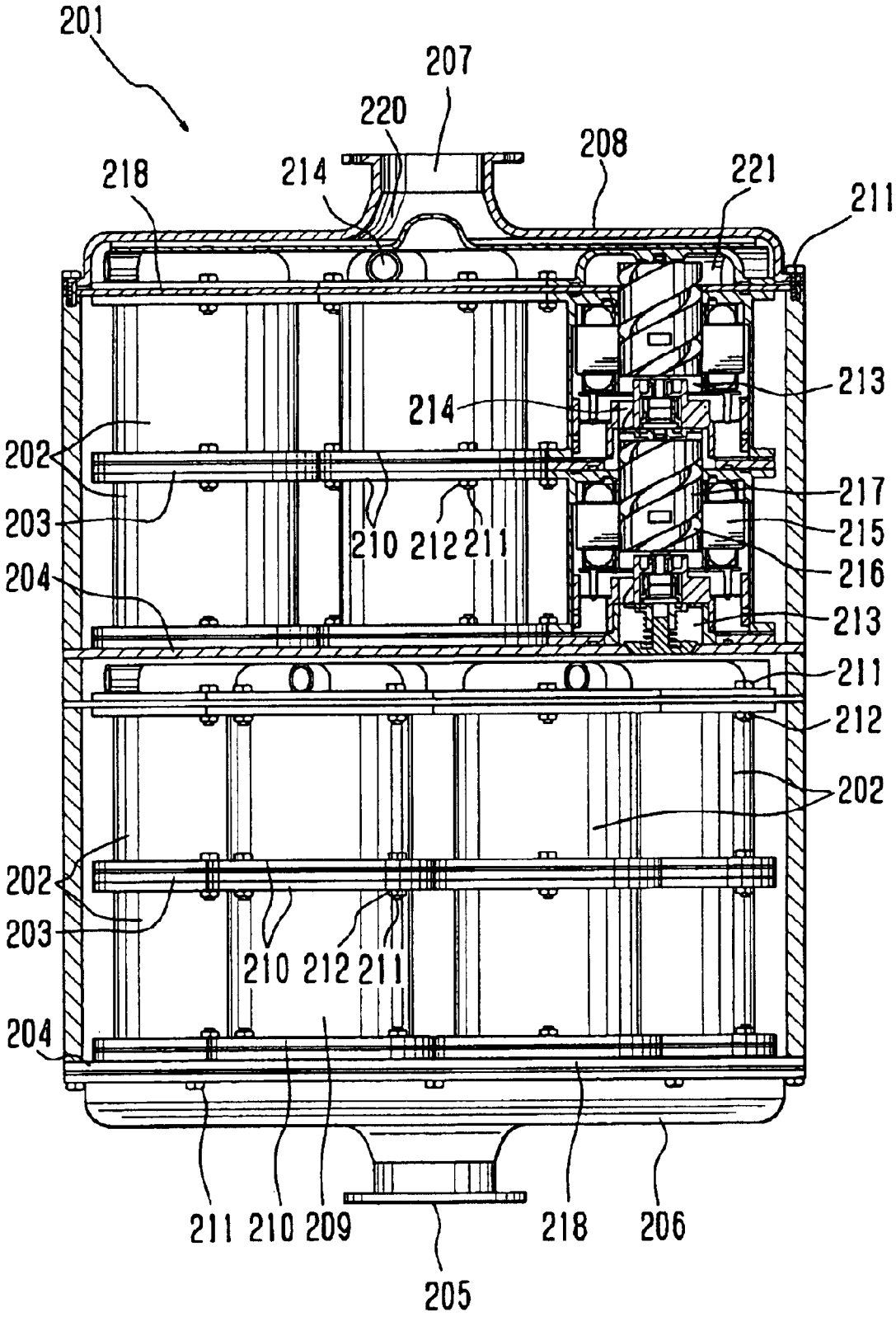
FIG. 10 is a full body vertical cross-section cutting one part of the cell pump, as a fifth application of the integrated pump of this invention.

The fifth embodiment of the integrated pump of this invention is explained with reference to FIG. 10. The explanation is abbreviated, as one part of this application is similar to the embodiment 1. FIG. 10 is a full body vertical cross-section of the integrated pump showing a cutting view of the cellpumps.

The integrated pump 201 of this application has a structure made up of 2 layers of cell pump assemblies connected in series with structure 204, wherein the assemblies are made of 2 cell pumps 202 connected in series as a series connected structure.

Embodiment 6

Figure 11:
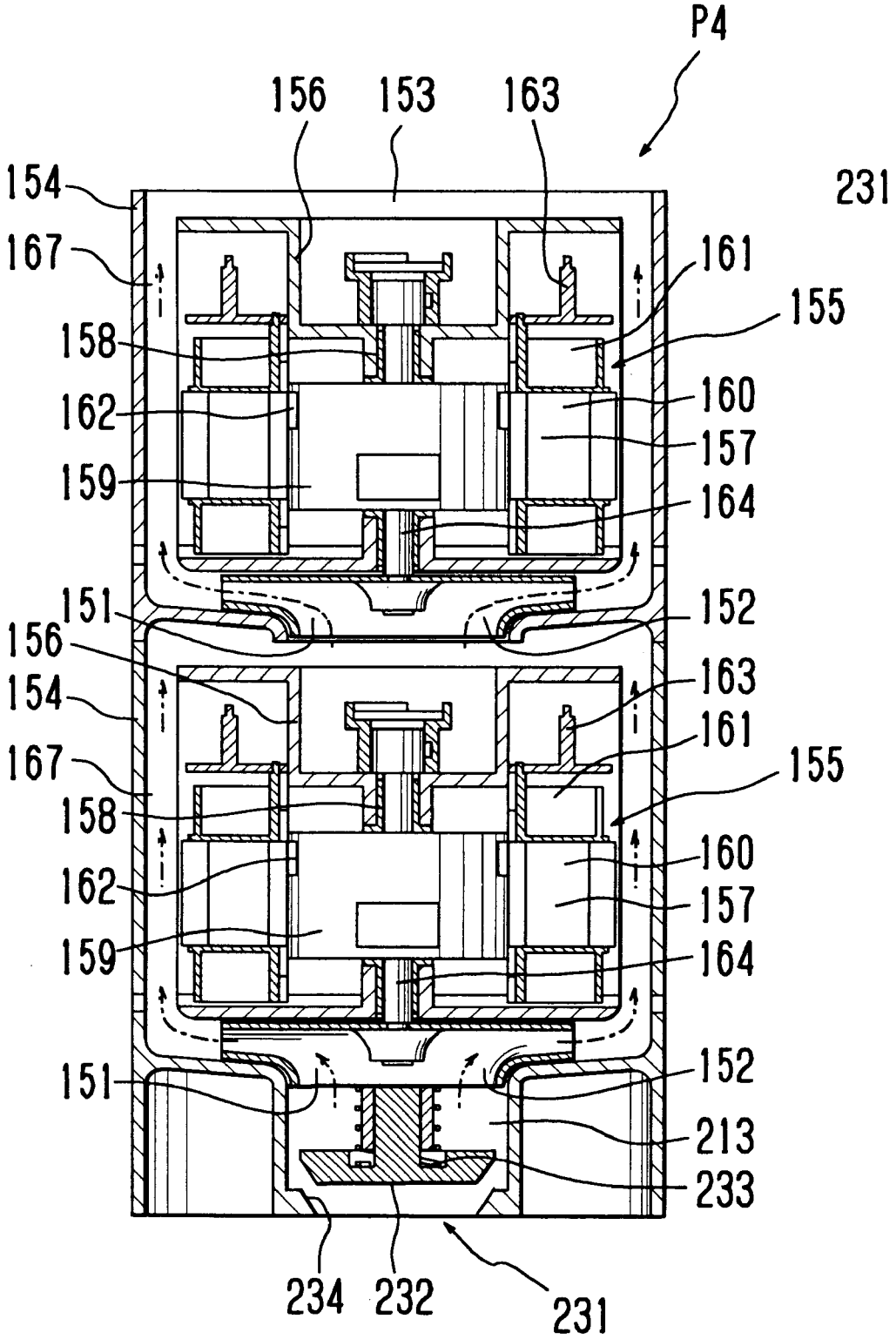
FIG. 11 is a vertical cross-section showing the internal structure of cell pumps using a centrifugal impeller, as a sixth application of this integral pump of the invention.

The sixth embodiment of the integrated pump of this invention is explained with reference to FIG. 11. The explanation is abbreviated, as one part of this application is similar to the embodiment 1

The integrated pump of this application has no difference with that indicated in embodiment 2 except that the cell pump 202 in this case are the cell pump P4 using a centrifugal impeller 151 as indicated in the embodiment 5.

Thus, in this example, if the centrifugal impeller 151 is rotated by means of the motor 155, fluid flows into the flow path 167 from the inlet 152, and is then discharged from the outlet 153. Such flow is generated by 2 cell pumps P4, and hence increase in head can be handled.

Further, this embodiment indicates arrangement of the integrated pump as indicated in the embodiment 2, however even regarding cell pump P4 which drives the fluid to the centrifugal impeller 151, various arrangements are possible.

Figure 12:
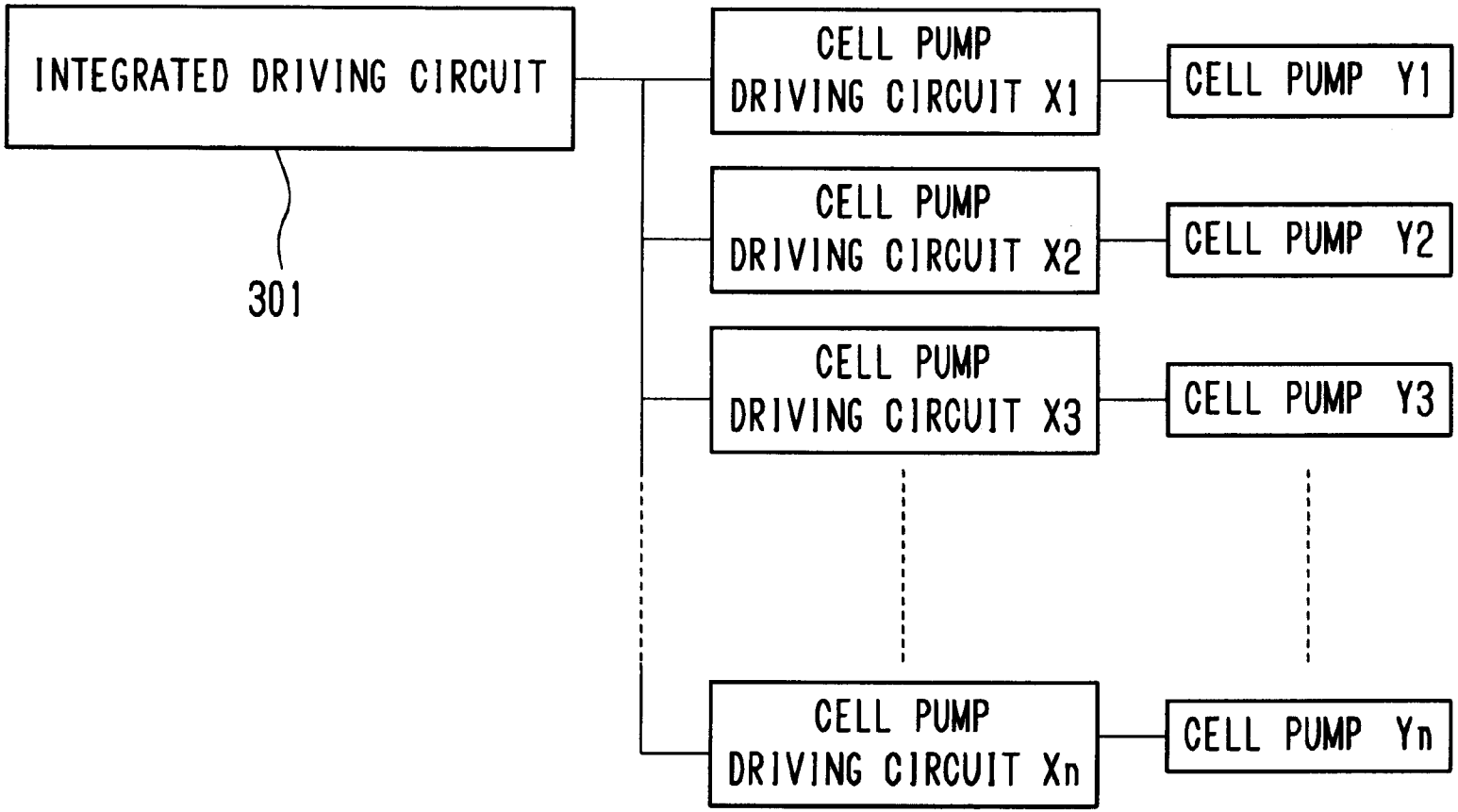
FIG. 12 is a drive control block diagram of this invention.

FIG. 12 indicates the drive control block diagram for cell pump 202, indicated in the embodiments 1–6. Depending upon a command signal of the integrated drive circuit 301, individual cell pump driving circuits (X1,X2 . . . Xn) are arranged so that an independent control of individual cell pumps 202 becomes possible. Normally at the time of starting of the pump large load is generated as compared to normal run and thereby increasing the input current. Therefore if individual cell pumps (Y1, Y2, . . . Yn) are started simultaneously, starting current of each cell pump gets added and thus very large input current is generated. However depending upon provision of the integrated driving circuit as mentioned above, at the time of starting of the integrated pump 201, starting from the cell pump 202 located on the suction side of the integrated pump each cell pump can be started one by one giving a starting interval between them. Thereby the input current at the time of starting can be drastically reduced, and consequently a considerable reduction in rated capacity of power can be achieved.

Further, in case of the output control or reducing capacity or head, conventionally the same is done by means of valve etc. As a result even with reduction in capacity the same power is to be is supplied. However in case of the integrated pump of this invention, each cell pump is operating at rated output for maximum efficiency. By stopping of cell pumps one by one starting with cell pump 202 located on the discharge side, and thereby controlling the number of cell pumps operating, running of the integrated pump 201 without any drop in efficiency of total output is possible.

Obviously, numerous modifications and variations of the present invention are possible in light of the above teachings. It is therefore to be understood that within the scope of the appended claims, the invention may be practiced otherwise than as specifically described here in.

What is claimed is:

1. An integrated pump, comprising:

a plurality of cell pumps each having an inlet and an outlet to discharge fluid drawn from the inlet to the outlet;

a consolidated inlet for introducing fluid;

a consolidated outlet for exhausting fluid; and a flow structure for introducing fluid from the consolidated inlet when the cell pumps operate, the flow structure guiding introduced fluid from the consolidated inlet to the inlet of the cell pumps, and the flow structure guiding fluid discharged from the outlet of the cell pumps to the consolidated outlet;

wherein the flow structure, comprises:

a series connecting structure for connecting the outlet of one cell pump to the inlet of other cell pump to arrange the plurality of cell pumps in series;

a series consolidated inlet as the consolidated inlet arranged at a fluid introducing portion of the series cell pumps; and a series consolidated outlet as the consolidated outlet arranged at a fluid exhausting portion of the series cell pumps;

wherein the flow structure further comprises:

a parallel connecting structure for arranging the plurality of series cell pumps in parallel;

a consolidated inlet member having a parallel consolidated inlet as the consolidated inlet to connect inlets on fluid introducing sides of the series cell pumps arranged in parallel to the parallel consolidated inlet; and a consolidated outlet member having a parallel consolidated outlet as the consolidated outlet to connect outlets on fluid exhausting sides of the series cell pumps arranged in parallel to the parallel consolidated outlet.

2. An integrated pump according to claim 1, wherein at least one cell pump arranged uppermost in fluid flow from the consolidated inlet contains a check valve in the inlet.

3. An integrated pump according to claim 1, further comprising a controller for driving and controlling the respective cell pumps.

4. An integrated pump according to claim 1, wherein the controller controls the cell pumps from a cell pump located at the consolidated inlet side towards a cell pump located at the consolidated outlet so that the respective cell pumps sequentially start.

* * * * *